US005897204A

United States Patent [19]

Dittmer et al.

[11] Patent Number: 5,897,204

[45] Date of Patent: Apr. 27, 1999

[54] ANTI-JAMMING CLUTCH MECHANISM FOR A CLAMPING APPARATUS

[75] Inventors: Howard Roy Dittmer, Palatine; Edward George Thomas, Schaumburg, both of Ill.

[73] Assignee: Fluid Management, Wheeling, Ill.

[21] Appl. No.: 08/977,603

[22] Filed: Nov. 25, 1997

[51] Int. Cl.[6] ..... B01F 11/00

[52] U.S. Cl. ..... 366/209

[58] Field of Search ..... 366/110, 111, 366/208–217, 219, 605

[56] References Cited

U.S. PATENT DOCUMENTS

| | | | |
|---|---|---|---|
| 2,797,902 | 7/1957 | Beugler | 366/217 |
| 4,134,689 | 1/1979 | Ahrenskou-Sorensen | 366/211 |
| 4,497,581 | 2/1985 | Miller . | |
| 4,588,302 | 5/1986 | Pizzie et al. | 366/605 |
| 4,789,245 | 12/1988 | Morbeck | 366/217 |
| 4,834,548 | 5/1989 | Tempel et al. . | |
| 5,066,136 | 11/1991 | Johnson | 366/605 |
| 5,197,802 | 3/1993 | Miller et al. | 366/605 |
| 5,310,257 | 5/1994 | Altieri, Jr. et al. . | |
| 5,458,416 | 10/1995 | Edwards et al. | 366/605 |
| 5,711,601 | 1/1998 | Thomas et al. | 366/209 |

FOREIGN PATENT DOCUMENTS

| | | | |
|---|---|---|---|
| 91/08045 | 6/1991 | WIPO | 366/605 |

*Primary Examiner*—Charles E. Cooley
*Attorney, Agent, or Firm*—Hill & Simpson

[57] ABSTRACT

A clamping mechanism is provided for mixing apparatuses and other apparatuses that utilize clamping mechanisms. The clamping mechanism incorporates a clutch mechanism which prevents overtightening of the clamp mechanism in the closed or clamping direction. Also, the clamping mechanism incorporates a plurality of pins that serve as a stop to prevent the traveling arm of the clamp mechanism from being tightened against the stationary arm and further serve as a bias for the clutch mechanism to bias the male and female clutch components into a mating engagement thereby enabling the clamping mechanism to be easily rotated out of the fully open position and prevent a jamming of the clamping mechanism in the fully open position.

20 Claims, 7 Drawing Sheets

ANTI-JAMMING CLUTCH MECHANISM FOR A CLAMPING APPARATUS

BACKGROUND OF THE INVENTION

The present invention is directed toward clutch mechanisms and, more specifically, to clutch mechanisms for clamping apparatuses that are movable between a clamping position and a fully open position. Still more specifically, the present invention is directed toward a clutch mechanism for a clamping apparatus that biases the male and female clutch elements together when the clamping apparatus is in a fully open position to prevent clutch slippage in the fully open position.

Clamping mechanisms are employed in a number of different apparatuses, one type of which includes mixing apparatuses. Specifically, apparatuses that mix materials in a container by shaking or vibrating require a clamping mechanism to hold the container in place during the mixing process. An example of such a mixing apparatus is shown and described in the commonly assigned U.S. Pat. No. 5,711,601, the disclosure of which is incorporated herein by reference as if fully set forth herein.

Clamping apparatuses that are used to hold containers and other objects in position on a support plate or between two clamping plates typically include a clutch mechanism to prevent overtightening of the clamp mechanism. Typically, the clutch mechanism includes a female clutch plate with a plurality of grooves for accommodating teeth of the opposing male clutch plate. The teeth of the male clutch plate are typically angled in one direction thereby enabling the teeth to slip out of the grooves if the clamping mechanism and clutch plates are rotated with a force sufficient to cause overtightening of the clamp mechanism. Thus, clutch slippage is intended to be allowed in only one rotational direction (i.e. clamp tightening) and locked in an opposite direction (i.e. clamp loosening).

In addition to having a fully clamped or clamping position, clamp mechanisms typically have a fully open or release position which is arrived at when the moving clamp member engages a stop or frame member that prevents any further rotation of the clamp mechanism in the open direction. A problem has arisen in connection with these types of clamp mechanisms because operators who are attempting to work at a fast pace have the tendency of rotating the clamp mechanism in the open direction to the extent where the clamp mechanism can become jammed in the fully open position. Specifically, the operator will rotate the clamp mechanism towards the fully open position at such a rate that the moving clamp member becomes tightened against the stop or frame member that prevents any further movement towards the open position. This inadvertent tightening must be overcome by rotating the handle or actuator of the clamp mechanism back towards the clamping direction. However, as discussed above, clamping systems include a clutch mechanism which is designed to slip in the event the operator attempts to overtighten the clamping system in the closed or clamped position. The force required to cause the male and female clutch elements to slip is often small enough so that the male and female clutch elements often slip when the operator is attempting to unjam the clamping apparatus from the fully open position.

In short, by overtightening the clamp apparatus into the fully open position, the clutch mechanism, which prevents overtightening of the clamping apparatus in the clamped or closed position, can also prevent the unjamming of the clamping apparatus from the jammed fully-open position.

As a result, the apparatus must be disassembled in order to unjam the clamping apparatus. Of course, this causes great inconvenience and makes the mixing apparatus unusable until the clamping mechanism is unjammed.

As a result, there is a need for an improved clamping mechanism for mixing apparatuses and other apparatuses that employ a clamping mechanism which can prevent the clamping mechanism from being jammed in the fully open position while permitting the clamping mechanism to employ a clutch mechanism to prevent overtightening of the clamping mechanism in the clamped or fully closed position.

SUMMARY OF THE INVENTION

In accordance with the present invention, an apparatus is provided for releasably clamping an object in a position. The apparatus includes a support member for engaging the object to be held in position, the object being held between the support member and a traveling member. The traveling member is movable towards a clamping position with the object being clamped between the support member and the traveling member as well as a fully open position whereby the traveling member approaches, but does not engage a stationary member.

The traveling member is threadably mounted onto at least one threaded shaft that is connected to the stationary member and extends towards the support member. The threaded shaft is linked to a rotatable gear which engages a clutch mechanism that includes a female clutch plate and a male clutch plate. The clutch mechanism also is linked to a lever arm, the clutch mechanism being disposed between the stationary member and the lever arm. The gear is also disposed between the stationary member and the clutch mechanism.

Rotation of the lever arm, when the male and female clutch plates are in a mating engagement, imparts rotation to the male and female clutch plates, the gear and the threaded shaft thereby causing the traveling member to move along the threaded shaft either towards a clamping position or towards the,object to be clamped or towards an open position or away from the object to be clamped.

The stationary member accommodates at least one pin that is slidably received in an aperture disposed in alignment with both the gear and the clutch plates. The traveling member engages the pin when the apparatus is rotated towards the fully open position which causes the traveling member to move towards the stationary member. Before the traveling member engages the stationary member, the traveling member engages the pin which pushes the gear against the clutch plates thereby resulting in a biasing of the clutch plates together resulting in a mating engagement of the clutch plates which prevents clutch slippage in the fully open position.

Accordingly, the pin provides two benefits. First, the pin biases one clutch plate against the other clutch plate thereby preventing clutch slippage in the fully open position and, further, the pin prevents the traveling member from fully engaging the stationary member and therefore prevents the traveling member from being overtightened against the stationary member in the fully open position. Thus, the pin and the modified support member prevents the clamping apparatus from being jammed in the fully open position while allowing the clamping apparatus to employ a clutch mechanism which also prevents the clamping apparatus from being overtightened in the clamping position.

In an embodiment, the clamping apparatus of the present invention further comprises at least one spring member disposed between the lever arm and the clutch mechanism for biasing male and female clutch plates towards the stationary member and into a mating engagement thereby reducing clutch slippage when the lever arm is rotated.

In an embodiment, a handle is attached to the lever arm for manually rotating the handle and lever arm.

In an embodiment, the clamping apparatus comprises a pair of threaded shafts attached to opposing ends of the stationary member and being threadably connected to opposing ends of the traveling member. In such an embodiment, the gear further comprises a gear set as shown in FIG. 23 of U.S. Pat. No. 5,711,601 that links the clutch mechanism to both threaded shafts thereby enabling both threaded shafts to rotate in synch and causing the traveling member to move along both threaded shafts as the threaded shafts are rotated.

In an embodiment, the apparatus further comprises a pair of supporting rods that connect the support member to the stationary member.

In an embodiment, the support member is disposed vertically below the traveling member and remains stationary during rotation of the lever. The traveling member is disposed vertically below the stationary member and between the support and stationary members. The traveling member moves vertically downward when it moves towards the clamping position and vertically upward when it moves toward the fully open position.

In an embodiment, the male clutch plate is disposed between the lever arm and the female clutch plate and the female clutch plate is disposed between the male clutch plate and the gear that is engaged by the pin when the traveling member is moved to the fully open position.

In an embodiment, the rotatable gear further comprises a plurality of meshed gears disposed inside the stationary member that rotatably link the clutch plates to the threaded shaft.

In an embodiment, the clamping apparatus of the present invention is incorporated into a mixing apparatus for mixing a plurality of ingredients contained within a container. The container being clamped between the stationary and traveling members of the clamping apparatus.

In an embodiment, the present invention provides a method of retrofitting an existing clamping apparatus that includes a lower stationary member, a traveling member, at least one threaded rod, a stationary member, at least one gear and a clutch mechanism as discussed above. The method comprises the steps of drilling a hole in the stationary member that is in alignment with the gear and the clutch plate, inserting a pin through the hole, the pin being sized so that it is slidably received in the hole so that the pin is engaged by the traveling member when the threaded shaft is rotated to cause the traveling member to move towards the stationary member and into the fully open position, whereby engagement of the pin by the traveling member as the traveling member moves into the fully open position and causes the pin to engage the gear thereby biasing the gear against the clutch plates and thereby biasing the male and female clutch plates together and into mating engagement when the traveling member is in the fully open position.

It is therefore an object of the present invention to provide a clamp mechanism for a mixing apparatus which includes built-in safety mechanisms for preventing overtightening of the clamp mechanism in the clamped or fully closed position as well as overtightening of the clamp mechanism in the fully open or released position.

Another object of the present invention is to provide an improved clutch mechanism for clamping apparatuses which prevents clutch slippage in the fully open or released position.

Another object of the present invention is to provide an improved mixing apparatus having an improved clamping mechanism that cannot be overtightened in either the closed or open directions.

Yet another object of the present invention is to provide a method for easily retrofitting existing clamping mechanisms so that they cannot be overtightened in the fully open position which results in a jamming of the clamp mechanism.

Other objects and advantages of the present invention will become apparent upon reading the following detailed description and appended claims, and upon reference to the accompanying drawings.

BRIEF DESCRIPTION OF THE DRAWINGS

For a more complete understanding of the invention, reference should now be made to the embodiments illustrated in greater detail in the accompanying drawings and described below by way of an example of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
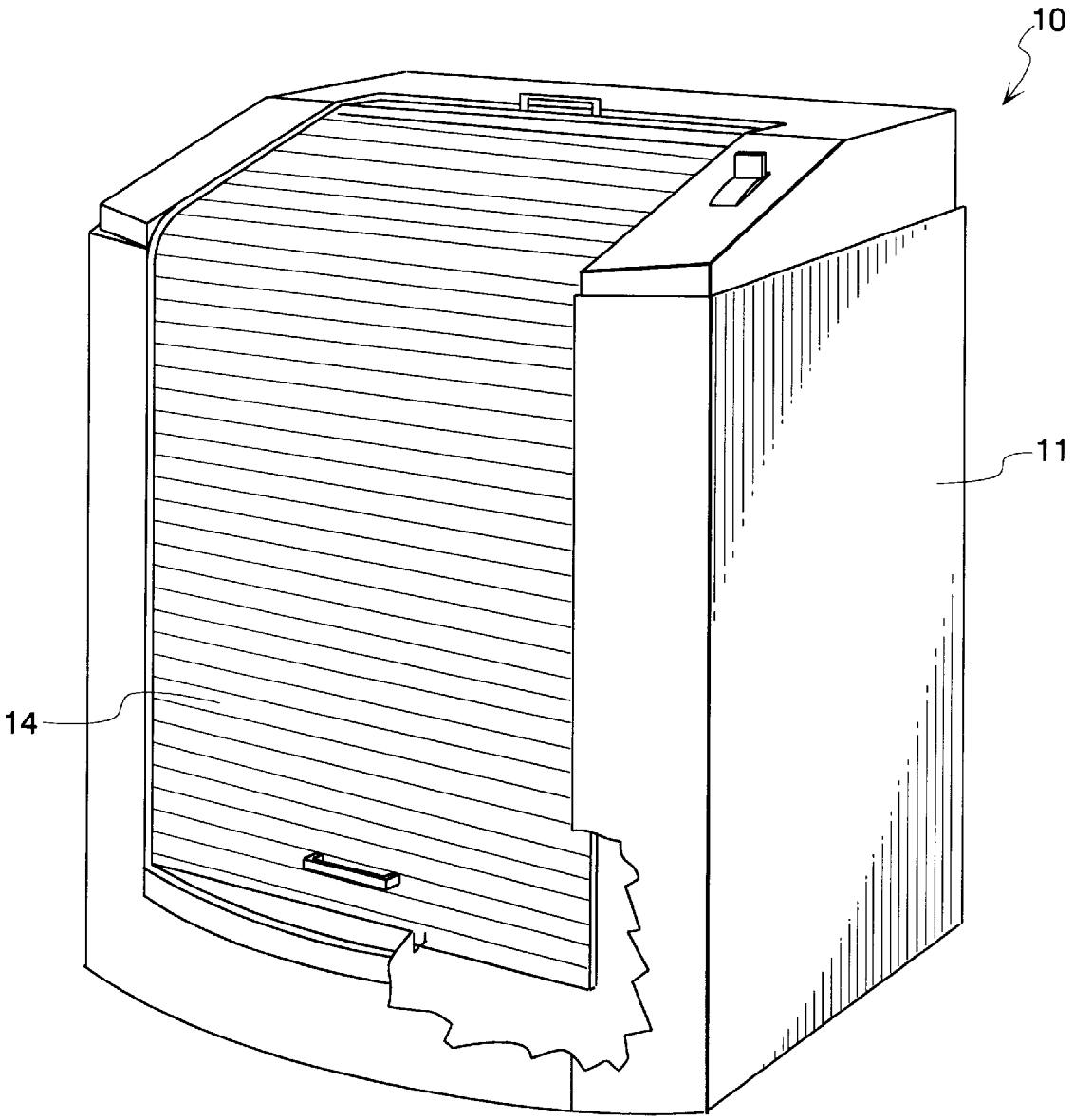
FIG. 1 is a perspective view of a mixing apparatus made in accordance with the present invention.

FIG. 1 illustrates a mixing device 10 of the type where a clamping mechanism (not shown in FIG. 1) made in accordance with the present invention can be successfully incorporated. Briefly, the mixing device 10 as shown in FIG. 1 includes a cabinet shown generally at 11 with a door 14 that is in a closed position. For mixing apparatus, like the device shown at 10 in FIG. 1, the door 14 is an important safety feature because of the rapid movement of the component disposed behind the door during the mixing operation as shown in FIG. 2.

Figure 2:
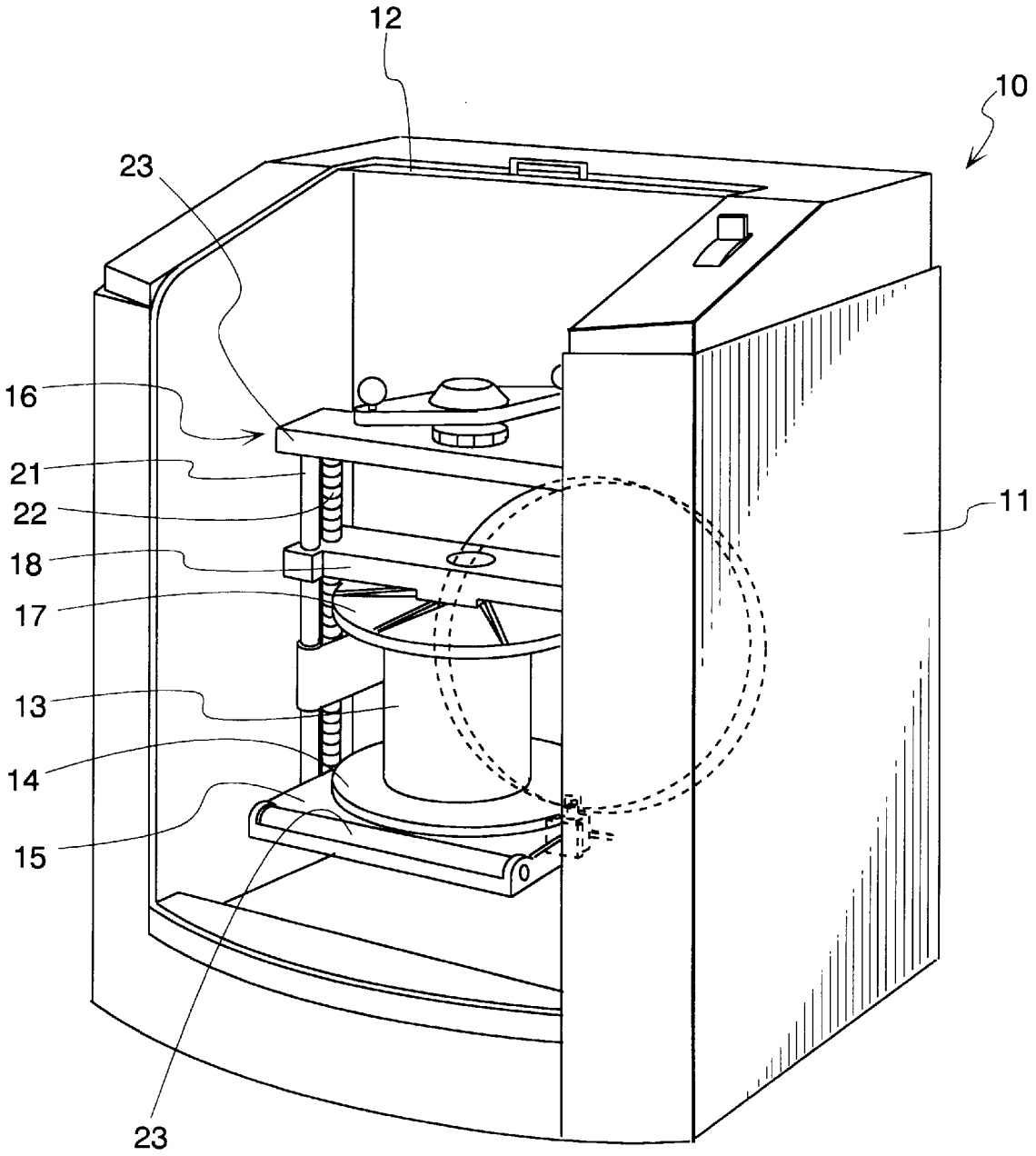
FIG. 2 is a perspective view similar to that of FIG. 1 but showing the cover in a raised position.

Turning to FIG. 2, the device 10 mixes components contained within a container 13 by shaking or rotating the container in a gyroscopic mixing motion in a manner similar to that disclosed in commonly owned U.S. Pat. No. 5,197,802, the disclosure of which is incorporated herein by reference as if fully set forth herein. The container 13 is supported on a lower clamping plate 14 which, in turn, is supported by a lower support member 15. In the embodiment shown in FIG. 2, the support member 15 remains stationary during the insertion and removal of the container 13. However, the entire clamping structure shown generally at 16 is shaken gyroscopically during the mixing operation.

Still referring to FIG. 2, the container 13 is clamped between the lower clamping plate 14 and the upper clamping plate 17. The upper clamping plate 17 may be attached to the traveling arm or upper clamping member 18. The traveling arm 18 rides up and down on a pair of support rods, only one of which is shown at 21 in FIG. 2, and a pair of threaded shafts, only one of which is shown at 22 in FIG. 2. The threaded shafts 22 are journaled in the traveling arm 18 and, as the threaded shafts 22 are rotated, the traveling arm 18 either moves upward into an open position or downward into the clamping position as shown in FIG. 2. The lower support member 15 may also include a roller 23 for facilitating the loading of the container onto the lower clamping plate 14.

Figure 3:
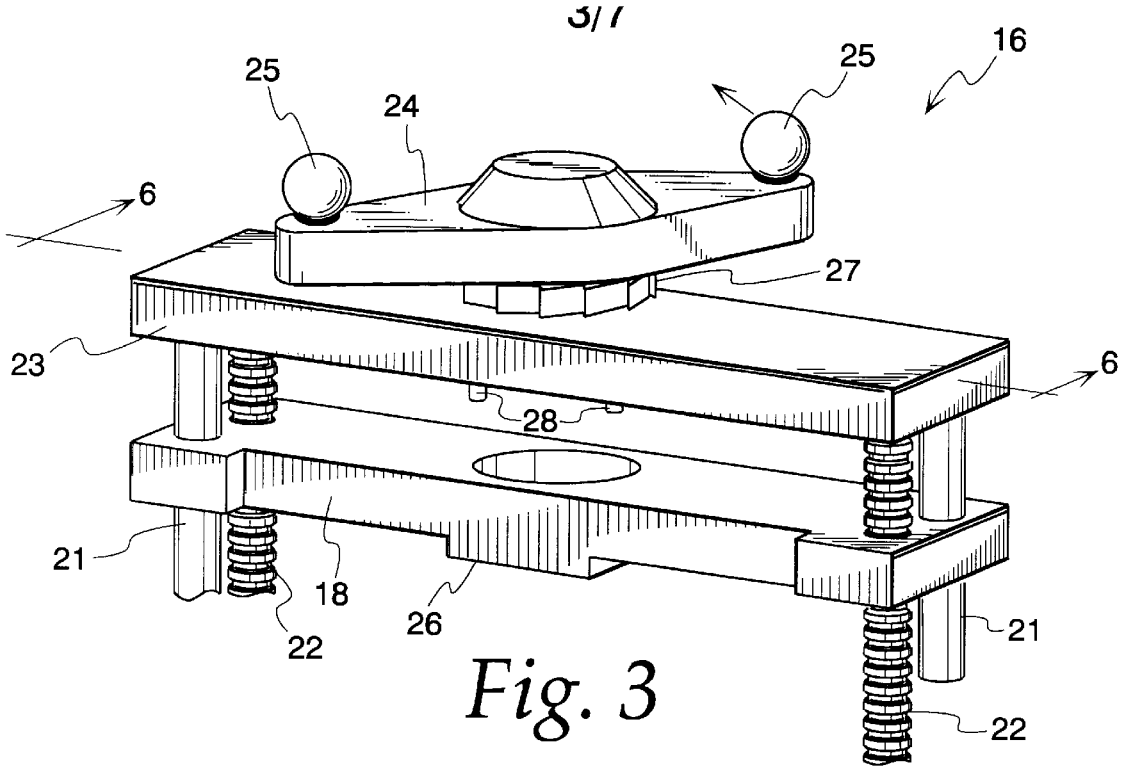
FIG. 3 is a partial perspective view of the clamping mechanism of the present invention.
Figure 4:
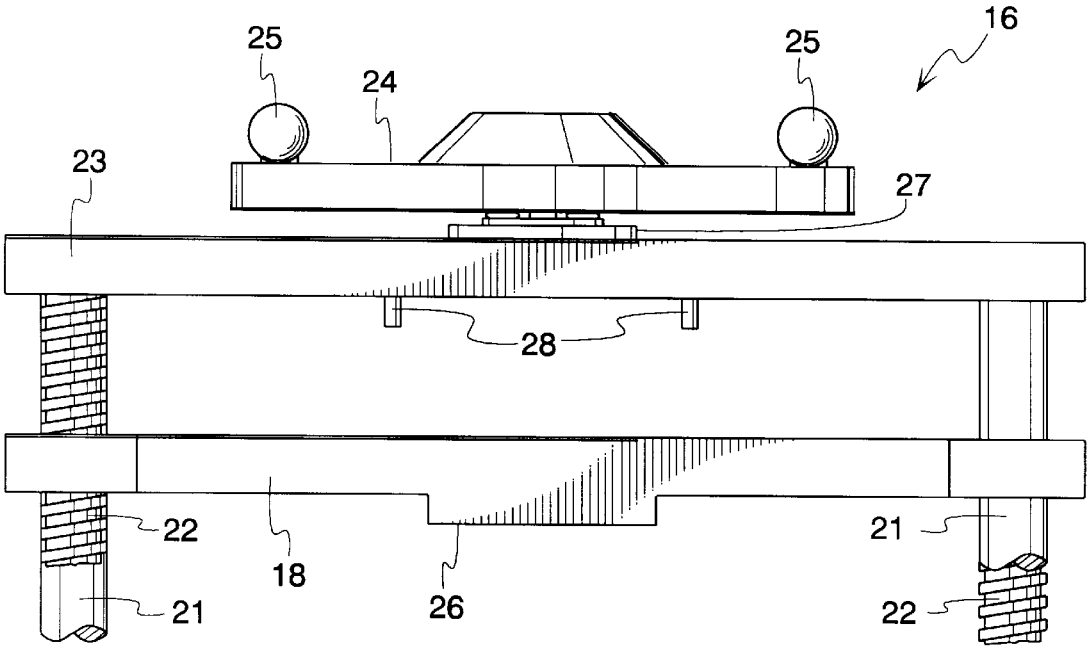
FIG. 4 is a partial elevational view of the clamping mechanism first shown in FIG. 3.

Turning to FIGS. 3 and 4, the upper portion of the clamping mechanism 16 is illustrated. The traveling arm 18 or upper clamping member moves up and down on the support rod 21 and threaded shafts 22. The threaded shafts 22 are journaled in the traveling arm 18 but are connected to the stationary arm 23. The stationary or gear arm 23 houses a gear set that transmits rotational movement from the lever arm 24 to the threaded shafts 22. The lever arm 24 may be equipped with one or more handles 25 for rotating the lever arm. The downwardly directed extension 26 of the traveling arm 18 engages the upper clamping plate 17 as shown in FIG. 2. The ratchet gear 27 cooperates during the clamping operation with a pawl (not shown) and is explained in detail in U.S. patent application Ser. No. 08/670,184. The pins shown at 28 serve as stops to prevent the traveling arm 18 from fully engaging the underside of the stationary arm 23 when the clamping mechanism 16 is moved to the fully-open position as explained below in connection with FIG. 9.

Figure 5:
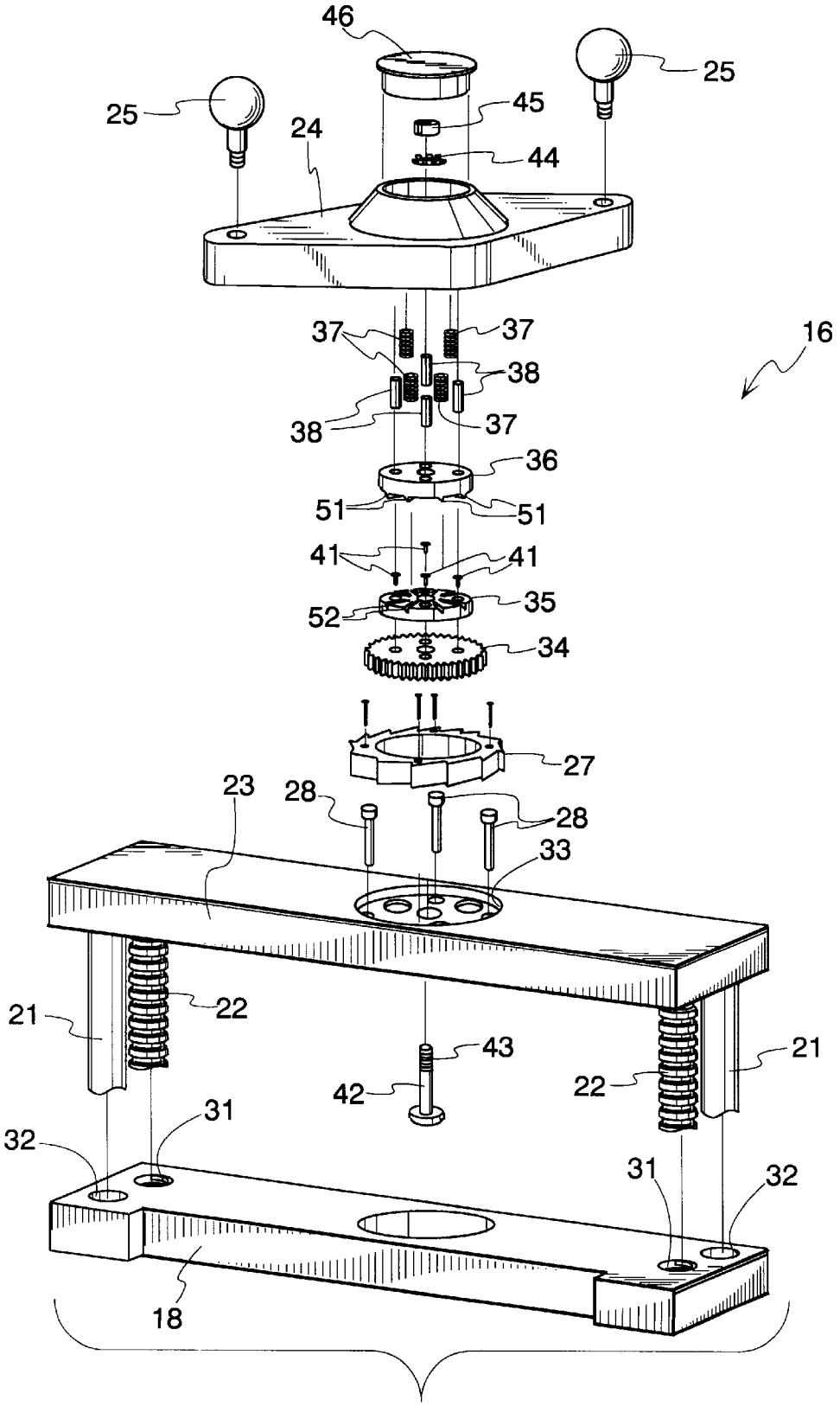
FIG. 5 is a partial exploded view of the clamping mechanism first shown in FIG. 3.

Turning to FIG. 5, a partially exploded view of the clamping mechanism 16 is illustrated. The traveling arm or member 18 includes threaded holes shown at 31 for accommodating the threaded shafts 22. Additional holes 32 are provided for slidably accommodating the support rods 21. The stationary arm or gear arm 23 includes a recessed area 33 for accommodating the central gear 34 which is connected to the female clutch member 35. The underside of the central gear 34 engages the pins 28. For purposes of clarity of illustration, the ratchet gear 27 is shown below the central gear 34, but in its final installed position, the ratchet gear 27 is disposed above the central gear 34, with the central gear 34 being accommodated in the recess 33 of the stationary member 23. A male clutch member is shown at 36 which is biased towards the female member 35 by a plurality of springs 37. The male clutch member 36 is linked to the lever arm 24 by the plurality of pins shown at 38. The female clutch member 35 is attached to the central gear 34 by the screw shown at 41. A support stud 42 having an upper threaded end 43 is secured to the bottom of the stationary support 23 and passes through the support member 23, ratchet gear 27, central gear 34, female clutch member 35, male clutch member 36 and lock washer 44 before threadably engaging the threaded fastener 45. In a preferred embodiment, the length of the threads 43 on the stud 42 are sufficiently long enough so as to permit a range of travel for clutch adjustment. In short, the amount of clamping force between the male clutch member 36 and female clutch member 35 can be adjusted by adjusting the position of the threaded fastener 45 on the threaded end 43 of the stud 42.

Figure 6:
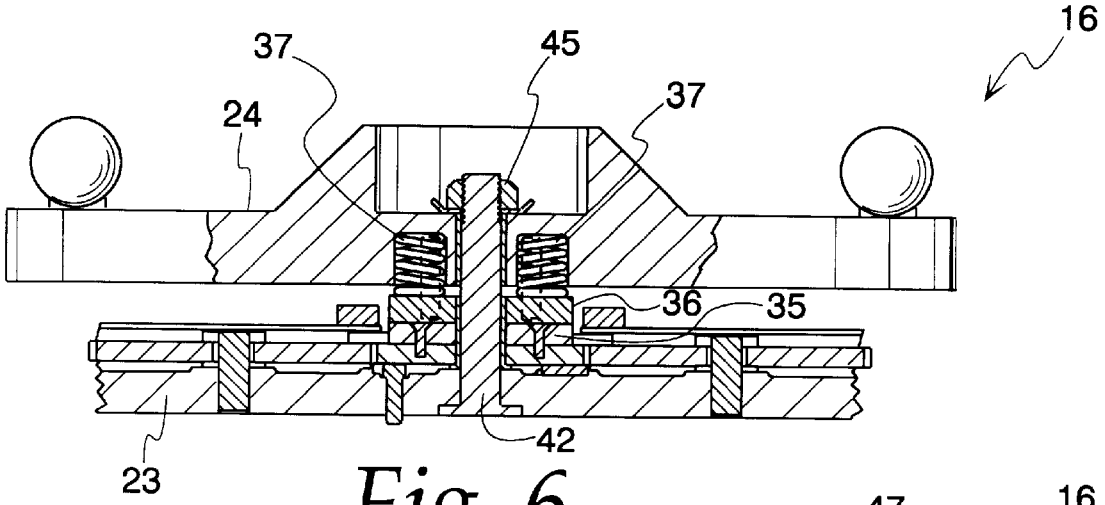
FIG. 6 is a sectional view taken substantially along line 6—6 of FIG. 3.
Figure 7:
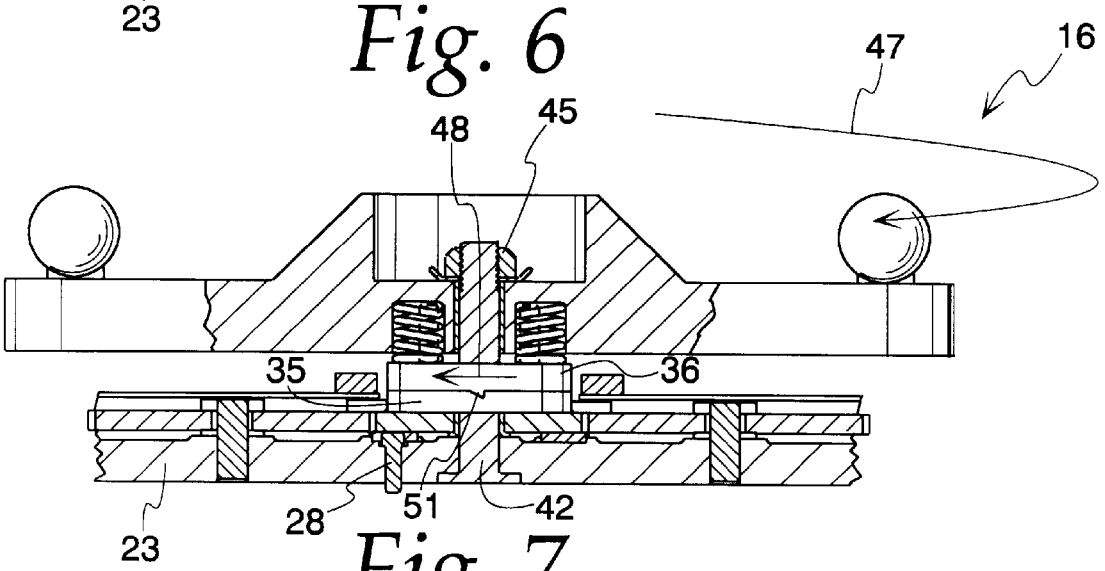
FIG. 7 is another sectional view taken substantially along line 6—6 of FIG. 3.
Figure 8:
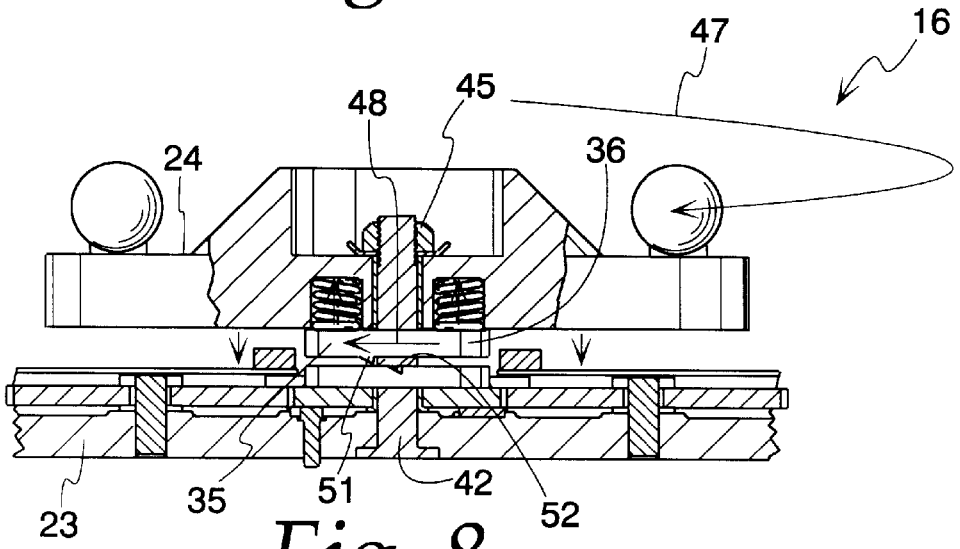
FIG. 8 is another sectional view taken along line 6—6 of FIG. 3.

Turning to FIGS. 6–8, the operation of the clamping mechanism is illustrated. Turning first to FIG. 6, adjustment of the clutch may be easily performed by removing the cap 46 (see FIG. 5) from the lever arm 24 thereby permitting access to the threaded fastener 45. The male 36 and female 35 clutch elements are biased together by the springs 37. As shown in FIGS. 7 and 8, rotation of the lever arm 24 in the direction of the arrow 47 will result in rotation of both clutch plates in the direction of the arrow 48 so long as the shear force imposed between the male 36 and female clutch plates 35 is not sufficient enough to dislodge the plurality of teeth 51 of the male clutch member 36 from the slots 52 of the female clutch member 35 (see also FIG. 5). The amount of shear force required to dislodge the teeth 51 of the male clutch member 36 from the slots 52 of the female clutch member 35 is, of course, adjustable and depends upon the strength of the springs 37 and the position of the threaded fastener 45 on the stud 42.

Referring to FIG. 8, the clutch slippage illustrated therein, is intended to prevent overtightening of the clamp mechanism 16 and the downward or clamping direction. In this way, the clamp mechanism 16 cannot be inextricably clamped downward or overtightened against a container 13. The slippage of the clutch members 36, 35 prevent this occurrence.

Figure 9:
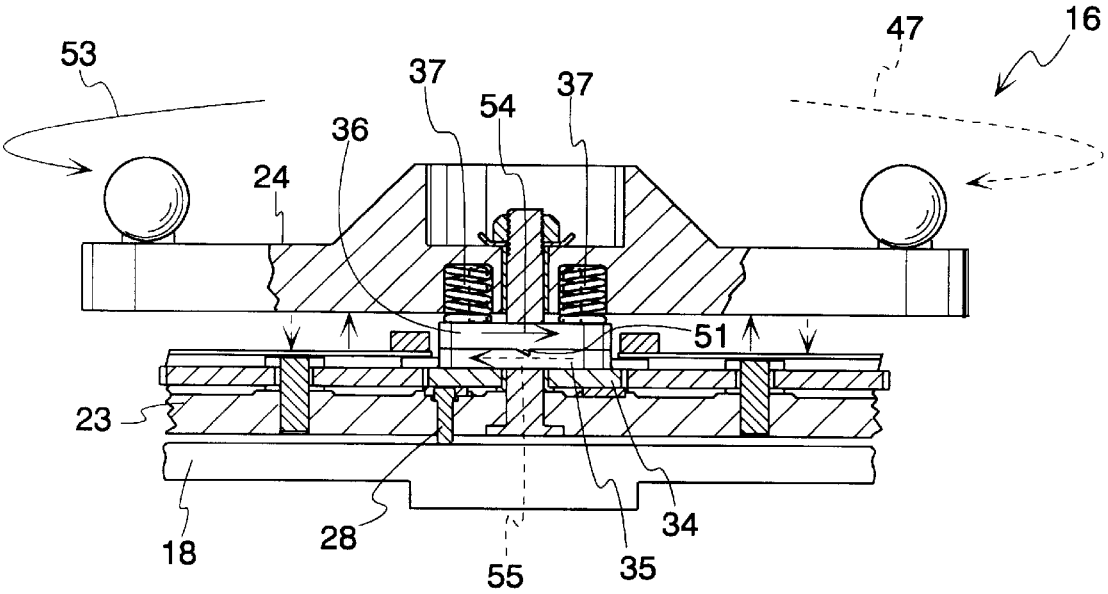
FIG. 9 is another sectional view taken substantially along line 6—6 of FIG. 3.
Figure 10:
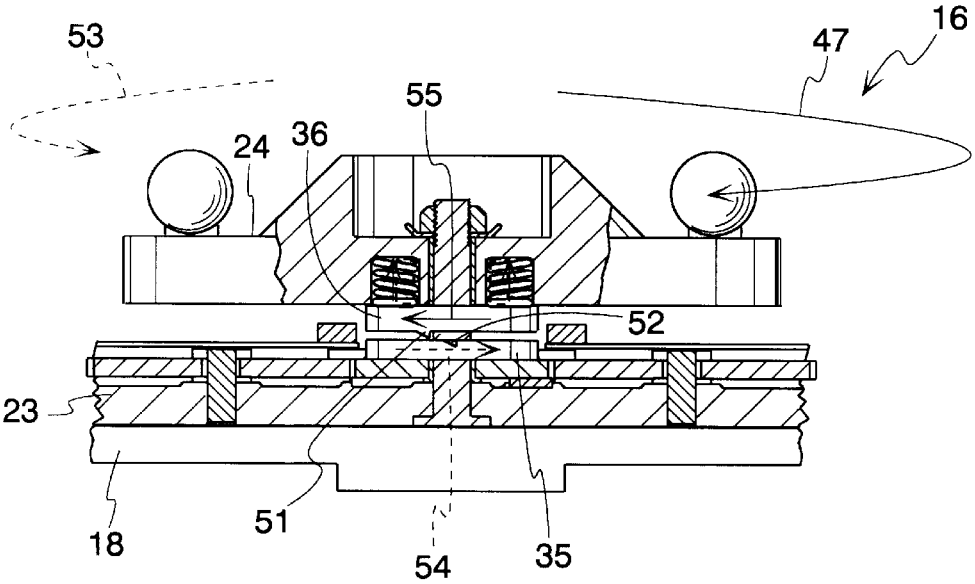
Fig. 10 PRIOR ART
FIG. 10 is a sectional view of a prior art clamping mechanism.

However, as shown in FIGS. 9 and 10, the clutch members 35, 36 may slip when the clamp mechanism 16 is rotated to the fully open position. Specifically, referring to FIG. 10, without the pins 28 inserted through the stationary arm 23, rotation of the swing arm in the direction of the arrow 53 will result in the traveling arm 18 engaging the stationary arm 23. An inexperienced operator could overtighten the lever arm 24 in the direction of the arrow 53. Overtightening is possible because when the lever arm 24 is rotated in the direction of the arrow 53, the clutch plates 35, 36 rotate in the direction of the arrow 54 (shown in solid line in FIG. 9 and in phantom in FIG. 10). As a result, because the teeth 51 of the male clutch member 36 are not configured to slip out of the notches 52 of the female clutch member 35 when the clutch members 35, 36 are rotated in the direction of the arrow 54, no clutch slippage will result and the traveling arm 18 can be overtightened against the stationary arm 23 if the embodiment shown in FIG. 10 is utilized. However, with the placement of the pins 28 through the stationary member 23, the pins 28 serve as a stop and prevent the traveling arm 18 from engaging the underside of the stationary arm 23. Additionally, the upward pressure on the pin 28 by the traveling arm 18 as illustrated in FIG. 9, biases the pin 28 against the central gear 34 which, in turn, biases the female clutch member 35 upward against the male clutch member 36 which, in turn, is biased downward by the springs 37. Thus, in addition to serving as an impediment to the traveling arm 18 from engaging the stationary arm 23, the pin 28 also biases the female clutch member 35 upward so that the male and female clutch members maintain a mating engagement thereby enabling the lever arm 24 to be rotated in the direction of the arrow 47 (shown in phantom in FIG. 9) and permitting the clamping mechanism 16 to be easily rotated out of the fully open position shown in FIG. 9. In contrast, referring to FIG. 10, the clamping mechanism 16 as shown is jammed and rotation in the direction of the arrow 47 (shown in solid line in FIG. 10) is prevented by the slippage between the clutch members 35, 36 as shown in FIG. 10.

Figure 11:
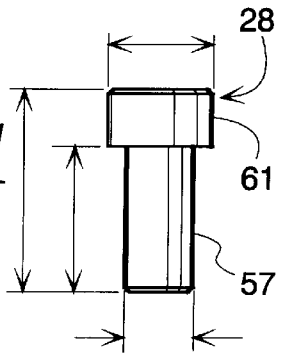
FIG. 11 is an elevational view of the pin that is accommodated in the gear arm and that engages the traveling arm or when the traveling arm has been moved into the fully open position.
Figure 12:
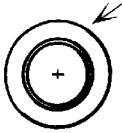
FIG. 12 is a bottom plan view of the pin shown in FIG. 11.
Figure 13:
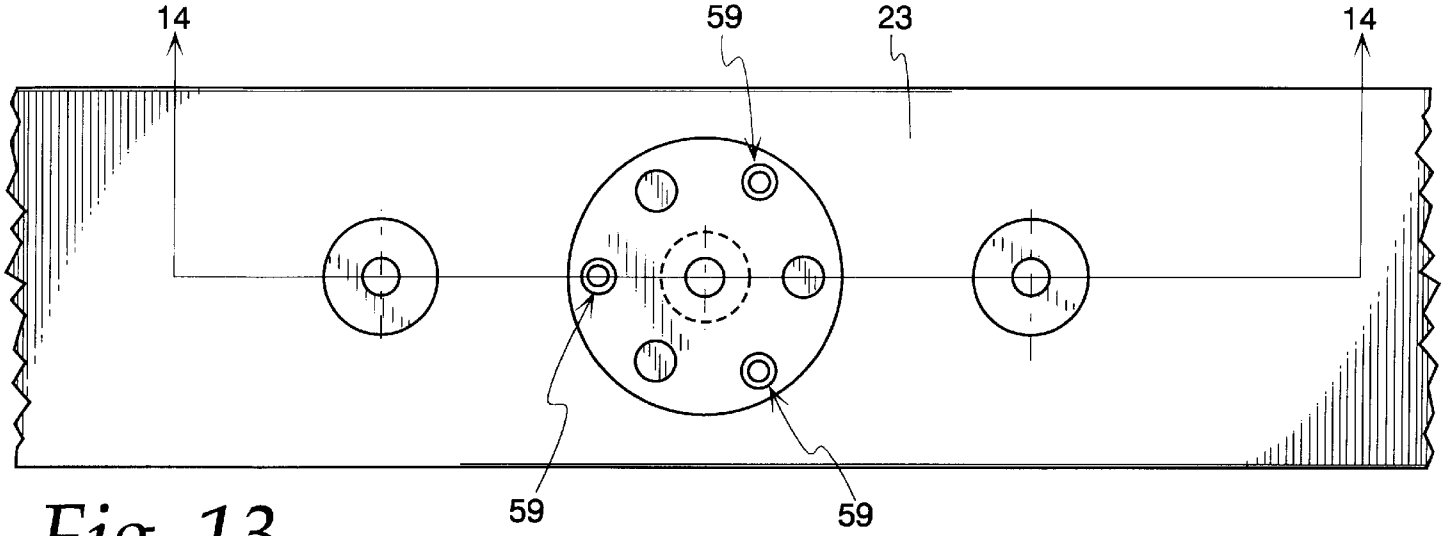
FIG. 13 is a partial top plan view of the gear arm of the clamping mechanism of the present invention.
Figure 14:
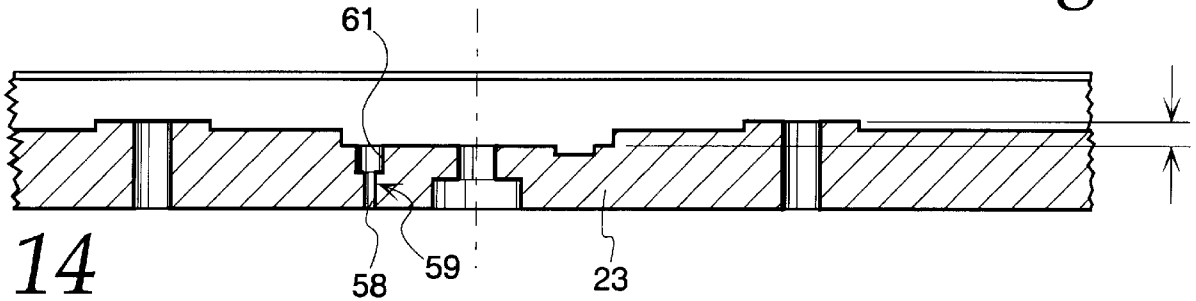
FIG. 14 is a partial sectional view taken substantially along line 14—14 of FIG. 13.

The specifics of the pins 28 are shown in FIGS. 11 and 12. The shaft portion 57 is accommodated in the narrow passage 58 of the hole 59 that extends through the lower portion of the stationary or gear arm 23 (see FIG. 14). The head portion 61 of the pin 28 (see FIG. 11) is accommodated in the wider portion 62 of the hole 59 (see FIG. 14). As shown in FIG. 13, in a preferred embodiment, three pins 28 are utilized and, accordingly, three holes 59 are provided in the gear arm 23.

It is also anticipated that the present invention could be used as a method of retrofitting an existing clamping mechanism of an existing mixing apparatus or other suitable apparatus that incorporates a similar clamping mechanism. The holes such as those shown at 59 can be easily drilled in the stationary arm 23 and appropriate sized pins 28 can be inserted into the holes 59. After the appropriate clutch adjustment has been made, the pins 28 will serve to bias the clutch components 35, 36 together when the clamping mechanism 16 is in the fully open position to facilitate the turning of the lever arm 24 in the direction of the arrow 47 so as to enable the clamping mechanism 16 to be rotated out of the fully open position even if the operator has applied a greater force in rotating the lever arm 24 to the fully open position than necessary.

Accordingly, the present invention provides an improved clamping mechanism that prevents the clamping mechanism from being jammed in the fully open position while still utilizing a clutch mechanism to prevent the clamping mechanism from becoming overtightened in the clamping or closed position.

The drawings and foregoing descriptions are not intended to represent the only forms of the invention in regard to the details of its construction and manner of operation. Changes in form in the proportion of parts, as well as the substitution of equivalents, are contemplated as circumstances may suggest or render expedient; and although specific terms have been employed, they are intended in a generic and descriptive sense only and not for the purposes of limitation. The scope of the invention being delineated by the following claims.

What is claimed:

1. An apparatus for releasably clamping an object in position, the apparatus comprising:

a support member for engaging the object to be held in position, the object being held between the support member and a traveling member, the traveling member being movable towards a clamping position with the object being clamped between the support member and the traveling member, the travelling member also being movable away from the support member and into a fully open position to release the object, the traveling member being threadably mounted onto at least one threaded shaft, the threaded shaft further being connected to a stationary member, the traveling member being disposed between the support member and the stationary member, the threaded shaft being linked to at least one rotatable gear, the gear engaging one of a female clutch plate and a male clutch plate, the other of the male and female clutch plates being linked to a lever arm, the male and female clutch plates being disposed between the stationary member and the lever arm, the gear being disposed between the stationary member and the clutch plates, whereby rotation of the lever arm, when the male and female clutch plates are in a mating engagement, imparts rotation to the male and female clutch plates, the gear and the threaded shaft thereby causing the traveling member to move along the threaded shaft, the stationary member accommodating at least one pin that is slidably received in an aperture disposed in alignment with the gear and the clutch plates, the traveling member engaging the pin when the threaded shaft is rotated to cause the traveling member to move towards the stationary member and into the fully open position, whereby engagement of the pin by the traveling member as the traveling member moves into the fully open position causes the pin to engage the gear thereby biasing the gear against the clutch plates thereby biasing the male and female clutch plates together and into mating engagement so that roational movement of the lever arm is transmitted through the clutch plates, the gear and to the threaded shaft thereby enabling the traveling member to be moved from the fully open position towards the clamping position.

2. The apparatus of claim 1 further comprising at least one spring disposed between the lever arm and the male and female clutch plates for biasing the male and female clutch plates towards the stationary member and into mating engagement between the male and female clutch plates so that rotational movement of the lever arm is transmitted through the clutch plates and to the threaded shaft.

3. The apparatus of claim 1 wherein a handle is attached to the lever arm for manually rotating the handle and lever arm.

4. The apparatus of claim 1 further comprising a pair of threaded shafts attached to opposing ends of the stationary member, the threaded shafts being threadably connected to opposing ends of the traveling member.

5. The apparatus of claim 4 wherein the pair of threaded shafts are attached to opposing ends of the support member.

6. The apparatus of claim 1 further comprising a pair of supporting rods that connect the support member to the stationary member.

7. The apparatus of claim 1 wherein the support member is disposed vertically below the traveling member and the traveling member is disposed vertically below the stationary member and between the support and stationary members, the traveling member moving vertically downward when it moves toward the clamping position and vertically upward when it moves toward the fully open position.

8. The apparatus of claim 7 further comprising a pair of support rods that connect opposing sides of the support member to the stationary member and wherein the at least one threaded shaft comprises two threaded shafts passing through opposing sides of the traveling member and connected to opposing sides of the support and stationary members.

9. The apparatus of claim 1 wherein the male clutch plate is disposed between the lever arm and the female clutch plate and the female clutch plate is disposed between the male clutch plate and the stationary member, and the apparatus further comprises at least one spring disposed between the lever arm and the male clutch plate for biasing the male clutch plate into engagement with the female clutch plate so that rotational movement of the lever arm is transmitted through the clutch plates and to the threaded shaft.

10. The apparatus of claim 1 wherein the at least one rotatable gear is disposed inside the stationary member for rotatably linking the clutch plates to the threaded shaft.

11. An apparatus for releasably clamping an object in position, the apparatus comprising:

a lower clamping member for supporting the object to be held in position, the object being held between the lower clamping member and an upper clamping member, the upper clamping member being movable towards a clamping position with the object being clamped between the lower clamping member and the upper clamping member, the upper clamping member also being movable away from the lower clamping member and into a fully open position to release the object, the upper clamping member being threadably mounted onto two opposing threaded shafts, the threaded shafts further being connected to a stationary member and the lower clamping member, the upper clamping member being disposed between the lower clamping member and the stationary member, each threaded shaft being linked to at least one rotatable gear, the gear being connected to one of a female clutch plate and a male clutch plate, the other of the male and female clutch plates being connected to a lever arm, the male and female clutch plates being disposed between the stationary member and the lever arm, the lever arm engaging at least one spring that is disposed between the lever arm and the clutch plates for biasing the clutch plates towards the stationary member and into mating engagement between the male and female clutch plates so that rotational movement of the lever arm is transmitted through the clutch plates, whereby rotation of the lever arm, when the male and female clutch plates are in a mating engagement, imparts rotation to the male and female clutch plates, the gear and the threaded shafts thereby causing the upper clamping member to move along the threaded shafts, the stationary member accommodating at least one pin that is slidably received in an aperture disposed in alignment with said one gear of the gear set and the clutch plates, the upper clamping member engaging the pin when the threaded shafts are rotated to cause the upper clamping member to move towards the stationary member and into the fully open position, whereby engagement of the pin by the upper clamping member as the upper clamping member moves into the fully open position causes the pin to engage the gear thereby biasing the gear against the clutch plates thereby biasing the male and female clutch plates together and into mating engagement so that rotational movement of the lever arm is transmitted through the clutch plates, the gear and to the threaded shafts thereby enabling the upper clamping member to be moved from the fully open position towards the clamping position.

12. The apparatus of claim 11 wherein the gear is disposed inside the stationary member.

13. The apparatus of claim 11 wherein a handle is attached to the lever arm for manually rotating the handle and lever arm.

14. The apparatus of claim 11 further comprising a pair of supporting rods that connect the lower clamping member to the stationary member.

15. The apparatus of claim 11 wherein the male clutch plate is disposed between the lever arm and the female clutch plate and the female clutch plate is disposed between the male clutch plate and the stationary member.

16. A method of retrofitting a clamping apparatus to prevent the apparatus from becoming jammed in a fully open position, the apparatus including a support member for engaging the object to be held in position, the object being held between the support member and a traveling member, the traveling member being movable towards a clamping position with the object being clamped between the support member and the traveling member, the traveling member also being movable away from the support member and into a fully open position to release the object, the traveling member being threadably mounted onto at least one threaded shaft, the threaded shaft further being connected to a stationary member, the traveling member being disposed between the support member and the stationary member, the threaded shaft being linked to a rotatable gear, the gear being engaging one of a female clutch plate and a male clutch plate, the other of the male and female clutch plates being linked to a lever arm and being biased away from the lever arm by a spring disposed between the lever arm and the other of the male and female clutch plates, the clutch plates being disposed between the stationary member and the lever arm, the gear being disposed between the stationary member and the clutch plates, the method comprising the following steps:

drilling a hole in the stationary member in alignment with the gear and the clutch plates, inserting a pin in the hole, the pin being sized so that it is slidably received in the hole and so that the pin is engaged by the traveling member when the threaded shaft is rotated to cause the traveling member to move towards the stationary member and into the fully open position, whereby engagement of the pin by the traveling member as the traveling member moves into the fully open position causes the pin to engage the gear thereby biasing the gear against the clutch plates thereby biasing the male and female clutch plates together and into mating engagement when the traveling member is in the fully open position.

17. The method of claim 16 wherein the drilling step further comprises drilling a plurality of angularly spaced holes in the stationary member in alignment with the gear and the clutch plates, and the inserting step further comprises inserting one pin in the each hole, the pins being sized so that they are slidably received in the hole and so that each pin is engaged by the traveling member when the threaded shaft is rotated to cause the traveling member to move towards the stationary member and into the fully open position and biased against the gear.

18. A clamp assembly for a mixing apparatus, the clamp for releasably clamping a container containing a plurality of ingredients in position, the clamp assembly comprising:

a lower clamping member comprising a upwardly facing supporting plate for supporting a bottom of the container to be clamped, the upper clamping member comprising a downwardly facing clamping plate for engaging a top of the container, the upper clamping member being movable towards a clamping position with the container being clamped between the upwardly facing supporting plate and the downwardly facing clamping plate, the upper clamping member also being movable away from the lower clamping member and into a fully open position to release the container, the upper clamping member being threadably mounted onto two opposing threaded shafts, the threaded shafts further being connected to a stationary member and the lower clamping member, the upper clamping member being disposed between the lower clamping member and the stationary member, each threaded shaft being linked to at least one rotatable gear, the gear being connected to a female clutch plate, the female clutch plate being in abutting engagement with a male clutch plate, the male clutch plate being connected to a lever arm, the clutch plates being disposed between the stationary member and the lever arm, the lever arm engaging at least one spring that is disposed between the lever arm and the male clutch plate for biasing the male clutch plate into mating engagement with the female clutch plate so that rotational movement of the lever arm is transmitted through the clutch plates, whereby rotation of the lever arm, when the male and female clutch plates are in mating engagement, imparts rotation to the male and female clutch plates, the gear and the threaded shafts thereby causing the upper clamping member to move along the threaded shafts, the stationary member accommodating at least one pin that is slidably received in an aperture disposed in alignment with said one gear of the gear set and the clutch plates, the upper clamping member engaging the pin when the threaded shaft is rotated to cause the upper clamping member to move towards the stationary member and into the fully open position, whereby engagement of the pin by the upper clamping member as the upper clamping member moves into the fully open position causes the pin to engage the gear thereby biasing the gear against the clutch plates thereby biasing the male and female clutch plates together and into mating engagement so that rotational movement of the lever arm is transmitted through the clutch plates, the gear and to the threaded shafts thereby enabling the upper clamping member to be moved from the fully open position towards the clamping position.

19. The apparatus of claim 18 wherein the gear is disposed inside the stationary member.

20. The apparatus of claim 19 further comprising a pair of supporting rods that connect the lower clamping member to the stationary member.

* * * * *